US010427216B2

(12) United States Patent
Suzuki et al.

(10) Patent No.: US 10,427,216 B2
(45) Date of Patent: Oct. 1, 2019

(54) METHOD FOR PRODUCING LIQUID PHASE SINTERED ALUMINUM ALLOY MEMBER, AND LIQUID PHASE SINTERED ALUMINUM ALLOY MEMBER

(71) Applicant: Sumitomo Electric Sintered Alloy, Ltd., Takahashi (JP)

(72) Inventors: Rie Suzuki, Itami (JP); Shinichiro Shigezumi, Itami (JP); Toshihiko Kaji, Itami (JP)

(73) Assignee: Sumitomo Electric Sintered Alloy, Ltd., Takahashi-shi (JP)

( * ) Notice: Subject to any disclaimer, the term of this patent is extended or adjusted under 35 U.S.C. 154(b) by 639 days.

(21) Appl. No.: 15/023,790

(22) PCT Filed: Sep. 4, 2014

(86) PCT No.: PCT/JP2014/073308
§ 371 (c)(1),
(2) Date: Mar. 22, 2016

(87) PCT Pub. No.: WO2015/045780
PCT Pub. Date: Apr. 2, 2015

(65) Prior Publication Data

US 2016/0214174 A1 Jul. 28, 2016

(30) Foreign Application Priority Data

Sep. 27, 2013 (JP) ..... 2013-200780

(51) Int. Cl.
*B22F 3/24* (2006.01)
*C22C 1/04* (2006.01)
(Continued)

(52) U.S. Cl.
CPC ..... *B22F 3/1035* (2013.01); *B22F 1/0003* (2013.01); *B22F 3/16* (2013.01);
(Continued)

(58) Field of Classification Search
CPC ..... B22F 3/1035; B22F 3/16; B22F 1/0003; B22F 3/24; B22F 2301/052;
(Continued)

(56) References Cited

U.S. PATENT DOCUMENTS 5,368,629 A 11/1994 Kondo et al.
6,422,755 B1 * 7/2002 Cadle ..... B22F 5/00 29/888.092
2006/0013719 A1 * 1/2006 Ichikawa ..... C22C 21/10 419/29

FOREIGN PATENT DOCUMENTS

CN 101823133 A 9/2010
CN 103008202 A 4/2013
(Continued)

OTHER PUBLICATIONS

English machine translation of JP2009-242883, EPO, accessed Mar. 28, 2018.*
(Continued)

*Primary Examiner* — Jessee R Roe
*Assistant Examiner* — Rebecca Janssen
(74) *Attorney, Agent, or Firm* — Baker Botts L.L.P.; Michael A. Sartori

(57) ABSTRACT

A method for producing a liquid phase sintered aluminum alloy member, includes: a compacting process of compacting a raw material powder containing an aluminum alloy powder containing at least one element selected from Si, Mg, Cu, and Zn, with the balance being Al and unavoidable impurities to form a green compact; a sintering process of subjecting the green compact to liquid phase sintering to give a sintered body; a softening process of subjecting the sintered body to a heat treatment to give a softened material; a straightening process of sizing the softened material to give a straightened material; and an aging process of sub-
(Continued)

jecting the straightened material to a heat treatment to give an aged material in which precipitates are formed.

4 Claims, 4 Drawing Sheets

(51) Int. Cl.

| | |
|---|---|
| ***C22C 1/10*** | (2006.01) |
| ***C22C 21/00*** | (2006.01) |
| ***B22F 1/00*** | (2006.01) |
| ***B22F 3/16*** | (2006.01) |
| ***B22F 3/10*** | (2006.01) |
| ***C22C 21/02*** | (2006.01) |
| ***C22F 1/043*** | (2006.01) |
| *C22C 21/10* | (2006.01) |

(52) U.S. Cl.
CPC ..... *B22F 3/24* (2013.01); *C22C 1/0416* (2013.01); *C22C 1/1084* (2013.01); *C22C 21/00* (2013.01); *C22C 21/02* (2013.01); *C22F 1/043* (2013.01); *B22F 2301/052* (2013.01); *B22F 2998/10* (2013.01); *C22C 21/10* (2013.01)

(58) Field of Classification Search
CPC ..... B22F 2998/10; C22F 1/043; C22C 21/00; C22C 1/1084; C22C 1/0416; C22C 21/02; C22C 21/10
See application file for complete search history.

(56) References Cited

FOREIGN PATENT DOCUMENTS

| | | | | |
|---|---|---|---|---|
| JP | H01-294833 | A | | 11/1989 |
| JP | 5-039507 | A | | 2/1993 |
| JP | 5-043917 | A | | 2/1993 |
| JP | H05-140706 | A | | 6/1993 |
| JP | H06-212313 | A | | 8/1994 |
| JP | 2000-283060 | A | | 10/2000 |
| JP | 2002-220648 | A | | 8/2002 |
| JP | 2006-124779 | A | | 5/2006 |
| JP | 2006-316312 | A | | 11/2006 |
| JP | 2008-196009 | A | | 8/2008 |
| JP | 2009-242883 | A | | 10/2009 |
| JP | 2009242883 | A | * | 10/2009 |
| JP | 2013-227658 | A | | 11/2013 |
| JP | 2015-068185 | A | | 4/2015 |

OTHER PUBLICATIONS

Croucher, Water Quenching Aluminum, http://www.croucher.us/water-quenching (Jan 17, 2013), (Year: 2013).*
International Search Report in PCT International Application No. PCT/JP2014/073308, dated Nov. 11, 2014.
Notification of the First Office Action in counterpart Chinese Patent Application No. 201480053240.6, dated Nov. 2, 2016.
Notification of Reasons for Rejection in Japanese Patent Application No. 2013-200780, dated Aug. 16, 2016.

* cited by examiner

METHOD FOR PRODUCING LIQUID PHASE SINTERED ALUMINUM ALLOY MEMBER, AND LIQUID PHASE SINTERED ALUMINUM ALLOY MEMBER

TECHNICAL FIELD

The present invention relates to methods for producing liquid phase sintered aluminum alloy members suitable as, for example, various machine parts and to liquid phase sintered aluminum alloy members. More particularly, the present invention relates to a method for producing a liquid phase sintered aluminum alloy member, by which a liquid phase sintered aluminum alloy member having high strength and high dimensional accuracy is efficiently obtained.

BACKGROUND ART

Sintered members are used as machine parts in various applications, such as automobiles, OA equipment, and home appliances. Sintered members are suitable as materials of complex three-dimensional products because sintered members can be produced to have good mechanical properties, such as strength and abrasion resistance, and have shapes similar to final products.

With the trend toward reduction in weight of machine parts, there is a need for sintered members formed of more lightweight materials, and thus materials containing aluminum alloys have been proposed. For example, PTL 1 discloses a liquid phase sintered aluminum alloy formed so as to contain hard particles in an aluminum alloy for the purpose of achieving high strength and high abrasion resistance. This liquid phase sintered aluminum alloy is produced by compacting a mixed powder of an aluminum alloy powder and hard particles to form a green compact, subjecting the green compact to liquid phase sintering to give a sintered body, and further subjecting the sintered body to sizing and heat treatment.

CITATION LIST

Patent Literature

PTL 1: Japanese Unexamined Patent Application Publication No. 2009-242883

SUMMARY OF INVENTION

Technical Problem

In the above technique, however, the sintered body to form the liquid phase sintered aluminum alloy is sized before the heat treatment. The sintered body has room for further improvements in dimensional accuracy and the production method has room for further improvements in productivity.

The present invention has been made in light of the above-mentioned circumstances. An object of the present invention is to provide a method for producing a liquid phase sintered aluminum alloy member, by which a liquid phase sintered aluminum alloy member having high strength and high dimensional accuracy is efficiently provided. Another object of the present invention is to provide a liquid phase sintered aluminum alloy member having high strength and high dimensional accuracy.

Solution to Problem

A method for producing a liquid phase sintered aluminum alloy member according to the present invention includes the following processes:

(A) a compacting process of compacting a raw material powder containing an aluminum alloy powder containing at least one element selected from Si, Mg, Cu, and Zn, with the balance being Al and unavoidable impurities to form a green compact;

(B) a sintering process of subjecting the green compact to liquid phase sintering to give a sintered body;

(C) a softening process of subjecting the sintered body to a heat treatment to give a softened material;

(D) a straightening process of sizing the softened material to give a straightened material; and (E) an aging process of subjecting the straightened material to a heat treatment to give an aged material in which precipitates are formed.

A liquid phase sintered aluminum alloy member according to the present invention contains an aluminum alloy containing at least one element selected from Si, Mg, Cu, and Zn, with the balance being Al and unavoidable impurities. The liquid phase sintered aluminum alloy member has a relative density of 98% or more and a tensile strength of 200 MPa or more.

Advantageous Effects of Invention

In the method for producing a liquid phase sintered aluminum alloy member according to the present invention, a liquid phase sintered aluminum alloy member having high density and high strength as well as high dimensional accuracy can be produced with good productivity.

A liquid phase sintered aluminum alloy member according to the present invention has high density and high strength as well as high dimensional accuracy.

DESCRIPTION OF EMBODIMENTS

Description of Embodiments of Present Invention

Figure 1:
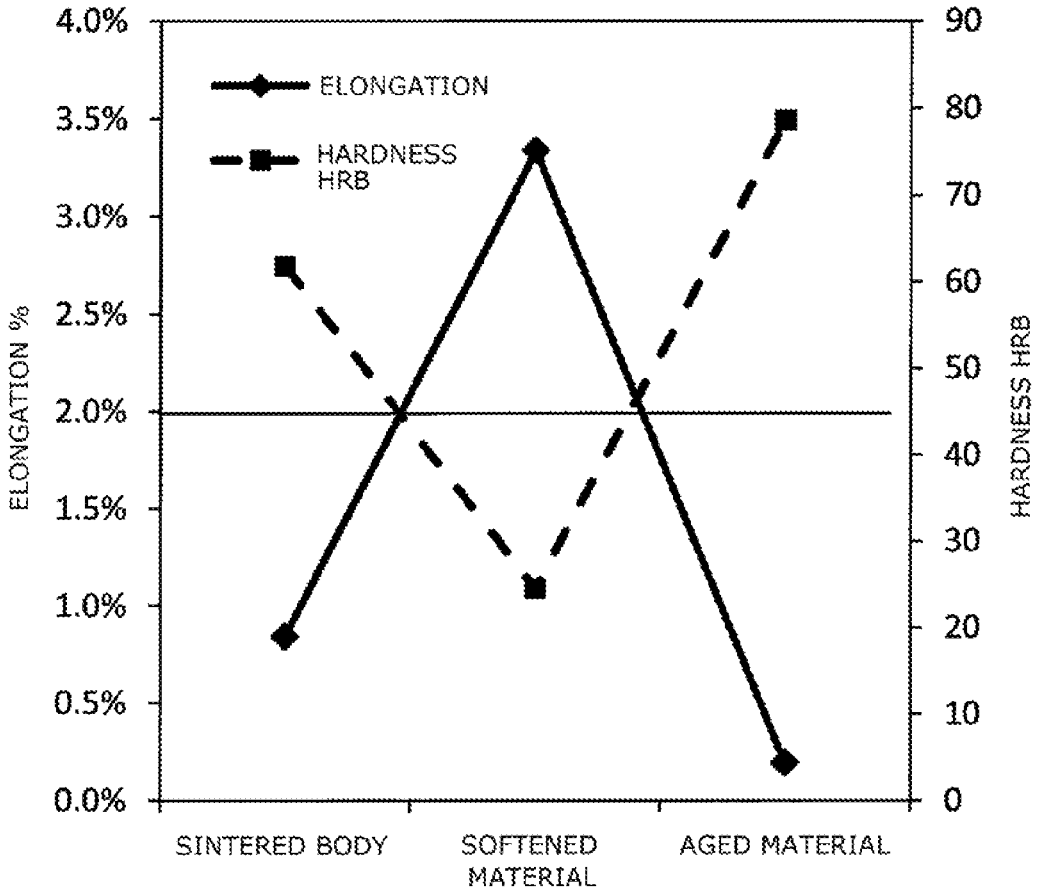
FIG. 1 is a graph illustrating the elongation and the hardness of an alloy in different processes in a method for producing a liquid phase sintered aluminum alloy member according to an embodiment.

To improve the dimensional accuracy of a sintered body, the inventors of the present invention have focused on a liquid phase sintered body to be sized, which considerably affects dimensional accuracy. A liquid phase sintered body is obtained by compacting a raw material powder to form a green compact and subjecting the green compact to liquid phase sintering. In general, a liquid phase sintered body contains fewer voids and has higher density and higher strength than a solid phase sintered body because the amount of voids between raw material powder particles is reduced due to a liquid phase in the liquid phase sintered body. The liquid phase sintered body, however, often requires a large amount of dimensional correction because the liquid phase sintered body undergoes large dimensional shrinkage due to rapid densification at the time of sintering and thus has large distortion.

When such a liquid phase sintered body is sized, a large amount of sizing (the amount of dimensional correction associated with plastic working) tends to cause cracking of the sintered body, resulting in a decrease in yield. This is because, when the liquid phase sintered body having high density and high strength is sized with a large amount of sizing, the sintered body tends not to conform to the die and the sintered body is subjected to an excess amount of stress, which may cause cracking of the liquid phase sintered body. In the case of, for example, a columnar or cylindrical liquid phase sintered body, the liquid phase sintered body is distorted in a direction perpendicular to the side surface. The amount of sizing for the distortion is as large as 0.5% or more of the entire length of the side surface.

The inventors have further studied improvements in plastic deformability of a liquid phase sintered body at the time of the sizing of the sintered body. As a result, the inventors have found the following findings: a liquid phase sintered body is unlikely to crack even with a large amount of sizing when the liquid phase sintered body is sized after being softened by a heat treatment, and a liquid phase sintered member having high dimensional accuracy can thus be obtained with good yield, completing the present invention. Features of embodiments of the present invention will be listed and described below.

(1) In an embodiment, a method for producing a liquid phase sintered aluminum alloy member includes the following processes:

(A) a compacting process of compacting a raw material powder containing an aluminum alloy powder containing at least one element selected from Si, Mg, Cu, and Zn, with the balance being Al and unavoidable impurities to form a green compact;

(B) a sintering process of subjecting the green compact to liquid phase sintering to give a sintered body;

(C) a softening process of subjecting the sintered body to a heat treatment to give a softened material;

(D) a straightening process of sizing the softened material to give a straightened material; and (E) an aging process of subjecting the straightened material to a heat treatment to give an aged material in which precipitates are formed.

In the method for producing a liquid phase sintered aluminum alloy member according to the embodiment described above, liquid phase sintering is performed so that the amount of voids between raw material powder particles is reduced due to a liquid phase and a liquid phase sintered body containing fewer voids and having higher density and higher strength than a solid phase sintered body is provided accordingly. This sintered body is processed by a heat treatment into a softened material and this softened material is then sized. This process order can reduce occurrence of cracks at the time of sizing and thus improves the yield because the softened material has high elongation and softness. In addition, a liquid phase sintered aluminum alloy member having high dimensional accuracy can be efficiently produced because the softened material conforms easily to a die at the time of sizing.

(2) In an embodiment, in the method for producing a liquid phase sintered aluminum alloy member, the softening process may be performed at a temperature sufficient for the softened material to have an elongation of 2% or more.

When the softened material has an elongation of 2% or more, cracks are unlikely to occur at the time of sizing. As the softened material is softer, it is easier for the softened material to conform to a die and it is thus easier to improve the dimensional accuracy.

(3) In an embodiment, in the method for producing a liquid phase sintered aluminum alloy member, the softening process may be performed at a temperature of 455° C. or more and 520° C. or less.

When the heat treatment temperature in the softening process is within the above range, it is easier to make the softened material have an elongation of 2% or more. When the heat treatment temperature is 455° C. or more, a softened material having plastic workability is easily formed in which cracks are unlikely to occur at the time of sizing. When the heat treatment temperature is 520° C. or less, the elongation sufficient for sizing can be obtained without further heating, and excess heating can be avoided.

(4) In an embodiment, in the method for producing a liquid phase sintered aluminum alloy member, the softening process may involve a solution treatment.

By the solution treatment, alloying elements can be sufficiently dissolved in an aluminum alloy.

(5) In an embodiment, in the method for producing a liquid phase sintered aluminum alloy member, the straightening process may be performed on the softened material having a hardness HRB of 50 or less.

Although the elongation of the softened material is improved by the heat treatment in the softening process, after the softened material is left to stand, the hardness of the softened material increases and the elongation decreases due to natural aging. When the straightening process is performed on the softened material having a hardness HRB of 50 or less, occurrence of cracks is easily reduced due to the softness of the softened material and, as a result, a liquid phase sintered aluminum alloy member having high dimensional accuracy is easily produced with good yield.

(6) In an embodiment, in the method for producing a liquid phase sintered aluminum alloy member, the aluminum alloy powder may be an Al—Si—Mg—Cu-based alloy powder.

A liquid phase sintered body of an Al—Si—Mg—Cu-based alloy has good abrasion resistance. However, the elongation of the Al—Si—Mg—Cu-based alloy is small, so that cracks tend to occur at the time of sizing or a member having low dimensional accuracy tends to be produced. By using the method for producing a liquid phase sintered aluminum alloy member according to the embodiment described above, a liquid phase sintered body of an Al—Si—Mg—Cu-based alloy having high dimensional accuracy can be efficiently produced.

(7) In an embodiment, a liquid phase sintered aluminum alloy member produced by the method for producing a liquid phase sintered aluminum alloy member according to any one of the embodiments (1) to (6) is provided.

The liquid phase sintered aluminum alloy member according to the embodiment has high density and high strength because it is formed through liquid phase sintering. The liquid phase sintered aluminum alloy member has high dimensional accuracy because the softened material is sized. In addition, the liquid phase sintered aluminum alloy member according to the embodiment is produced with good productivity because it can be easily produced by the method for producing a liquid phase sintered aluminum alloy member according to the embodiment.

(8) In an embodiment, the liquid phase sintered aluminum alloy member contains an aluminum alloy containing at least one element selected from Si, Mg, Cu, and Zn, with the balance being Al and unavoidable impurities. The liquid phase sintered aluminum alloy member has a relative density of 98% or more and a tensile strength of 200 MPa or more.

The liquid phase sintered aluminum alloy member according to the embodiment described above has a high relative density of 98% or more and a high tensile strength of 200 MPa or more.

(9) In an embodiment, the liquid phase sintered aluminum alloy member may have a surface roughness Rz of 6 or less.

The surface roughness Rz of 6 or less means that the liquid phase sintered aluminum alloy member is produced through the sizing where the sintered body conforms to a die. The liquid phase sintered aluminum alloy member thus formed has high dimensional accuracy.

(10) In an embodiment, the liquid phase sintered aluminum alloy member may have a squareness of 0.1% or less of the entire length.

When the liquid phase sintered aluminum alloy member has a corner that connects two surfaces of outer surfaces forming the member, the squareness between two surfaces is 0.1% or less of the entire length. That is, these two surfaces substantially form a right angle. The liquid phase sintered aluminum alloy member has high dimensional accuracy accordingly.

(11) In an embodiment, in the liquid phase sintered aluminum alloy member, the aluminum alloy may be an Al—Si—Mg—Cu-based alloy.

The liquid phase sintered aluminum alloy member has good abrasion resistance because the liquid phase sintered body is formed of the Al—Si—Mg—Cu-based alloy.

(12) In an embodiment, the liquid phase sintered aluminum alloy member may further contain hard particles made of a non-metal inorganic material and dispersed in a matrix phase formed of the aluminum alloy.

The abrasion resistance can be improved by dispersing hard particles in a matrix material formed of the aluminum alloy compared with the case of a matrix material alone.

DETAILED DESCRIPTION OF EMBODIMENTS OF PRESENT INVENTION

Embodiments of the present invention will be described below in detail. The present invention is not limited to these embodiments. The scope of the present invention is indicated by the claims and is intended to include all modifications within the meaning and range of equivalency of the claims. For example, the composition of a raw material powder, and the temperature, the time, and the other conditions of a sintering process, a softening process, and an aging process in Test Example described below can be appropriately modified.

<Method for Producing Liquid Phase Sintered Aluminum Alloy Member>

The method for producing a liquid phase sintered aluminum alloy member according to the embodiment includes a preparing process, a compacting process, a sintering process, a softening process, a straightening process, and an aging process as described below.

[Preparing Process]

An aluminum alloy powder is provided as a raw material powder. The aluminum alloy powder may be optionally mixed with different types of hard particles and used as a mixed powder.

(Aluminum Alloy Powder)

The aluminum alloy powder is formed of an aluminum alloy containing at least one element selected from Si, Mg, Cu, and Zn, with the balance being Al and unavoidable impurities. Examples of the aluminum alloy include an Al—Si—Mg—Cu-based alloy, an Al—Zn—Mg—Cu-based alloy, an Al—Si-based alloy, an Al—Cu-based alloy, an Al—Mg-based alloy, and an Al—Cu—Si-based alloy.

An Al—Si—Mg—Cu-based alloy is preferred because of its good abrasion resistance. In terms of specific composition, the Al—Si—Mg—Cu-based alloy may contain 6 mass % or more and 18 mass % or less of Si, 0.2 mass % or more and 1.0 mass % or less of Mg, and 1.2 mass % or more and 3.0 mass % or less of Cu, with the balance being Al and unavoidable impurities. Preferably, the Al—Si—Mg—Cu-based alloy contains 8 mass % or more and 15 mass % or less of Si.

An Al—Zn—Mg—Cu-based alloy is preferred because of its high strength. In terms of specific composition, the Al—Zn—Mg—Cu-based alloy may contain 5.1 mass % or more and 6.5 mass % or less of Zn, 2.0 mass % or more and 3.0 mass % or less of Mg, 1.2 mass % or more and 2.0 mass % or less of Cu, and 0.1 mass % or more and 0.3 mass % or less of Sn, with the balance being Al and unavoidable impurities. In addition, the Al—Zn—Mg—Cu-based alloy may have publicly-known compositions, such as compositions defined in 7075 and 7010 under JIS.

As a raw material powder, an aluminum alloy powder having a composition similar to that of the aluminum alloy described above may be used. Alternatively, a composite powder obtained by mixing a high-alloyed aluminum alloy powder having high concentrations of alloying elements and a high-purity aluminum powder substantially free of alloying elements may be used as a raw material powder. When the raw material powder contains a soft high-purity aluminum powder, good compactibility is obtained. The amount of the high-purity aluminum powder and the concentration of the alloying elements in the high-alloyed aluminum alloy powder can be appropriately selected. When this composite powder is used, a portion of the alloying elements of the high-alloyed aluminum alloy powder is dispersed in the high-purity aluminum powder in the sintering process described below to achieve a desired composition.

The average particle size of the aluminum alloy powder is preferably about 45 μm or more and 350 μm or less. The average particle size of this raw material powder can be assumed to be substantially the same as the average particle size of the raw material powder in an aluminum alloy member. The aluminum alloy powder having an average particle size of 45 μm or more is preferred because such an aluminum alloy powder is easy to use and thus has good handleability. The aluminum alloy powder having an average particle size of 350 μm or less is preferred because of its good compactibility.

The particle size distribution of the aluminum alloy powder as a raw material is measured by, for example, the Microtrac method (a laser diffraction/scattering method). The average particle size and the maximum diameter of the aluminum alloy particles in the liquid phase sintered aluminum alloy member are measured as follows. A cross section of the liquid phase sintered aluminum alloy member is observed with an optical microscope (at 100× to 400× magnifications). After this observed image is processed, the area of all aluminum alloy particles present in this cross section is measured. The equivalent circular diameter of each area is calculated and defined as a diameter of each particle. The maximum diameter in this cross section is defined as a maximum diameter of the particles in this cross section.

The maximum diameters of particles in cross sections (n=10) are determined and the average of ten maximum diameters is defined as a maximum diameter of the aluminum alloy particles. The average of the diameters of all particles in one cross section is determined and the averages of the diameters of all particles in cross sections (n=10) are determined. The average of ten averages of the diameters is defined as an average particle size of the aluminum alloy particles.

(Hard Particles)

Hard particles are made of a non-metal inorganic material. Examples of the non-metal inorganic material include ceramics, intermetallic compounds, and diamond. In particular, non-metal inorganic compounds can be preferably used. Specific materials include a Si simple substance and compounds, such as alumina ($Al_2O_3$), mullite (a compound of alumina and silicon oxide), SiC, AlN, and BN. When alumina is used among these materials, hard particles have good reactivity with a metal phase and thus provide a member having good abrasion resistance. When mullite is used, a member having low counterpart aggressiveness is obtained. These types of hard particles may be contained alone or as a mixture of two or more in the liquid phase sintered aluminum alloy member. The composition (simple elements, compound elements, and content) of the hard particles in the liquid phase sintered aluminum alloy member can be determined by using, for example, scanning electron microscopy-energy dispersive X-ray spectroscopy, X-ray diffraction, and chemical analysis.

The content of the hard particles in the liquid phase sintered aluminum alloy member (the total content when different types of hard particles are contained) is preferably 0.5 mass % or more and 10 mass % or less. When the content of the hard particles is 0.5 mass % or more, the liquid phase sintered aluminum alloy member tends to have an abrasion resistance similar to, equal to, or higher than those of other sintered members and can further have a practically sufficient strength and hardness. The lower limit of the content is more preferably 1 mass % or more.

As the content of the hard particles increases, the abrasion resistance and the hardness improve. When the content of the hard particles is more than 10 mass %, the liquid phase sintered aluminum alloy member has low strength, or when used as, for example, a slide member, causes significant wear or damages of counterparts, namely, has high counterpart aggressiveness. The upper limit of the content is more preferably 5.0 mass % or less, still more preferably 3.0 mass % or less.

The hardness of the liquid phase sintered aluminum alloy member tends to increase as the hardness of the hard particles increases or as the content of the hard particles increases.

A lower average particle size of the hard particles tends to result in a better abrasion resistance. When the average particle size of the hard particles is excessively large, the content of the hard particles is increased in order to ensure the same abrasion resistance as small particles. As a result, the liquid phase sintered aluminum alloy member has high counterpart aggressiveness when used as, for example, a slide member. For alumina particles, specifically, the average particle size is preferably 10 μm or less, more preferably 1 μm or more and 6 μm or less. When alumina particles having an average particular size satisfying the above range is contained in an amount within the above particular range, an advantage of increasing the sinterability for the alloy member is obtained. For mullite, the average particle size is preferably 20 μm or less, more preferably 1 μm or more and 15 μm or less. When the average particle size of the hard particles is excessively large and, for example, the alloy member is used as a slide member, the hard particles fall off at the time of the sliding of the alloy member in contact with a counterpart. If the slide member is slid with the hard particles interposed between the slide member and the counterpart, the counterpart aggressiveness then increases. Therefore, the maximum diameter of the hard particles is preferably 30 μm or less, more preferably 4 μm or more and 30 μm or less.

The particle size distribution of the hard particles used as a raw material is determined by, for example, the Microtrac method (laser diffraction/scattering method). The average particle size and the maximum diameter of the hard particles in the liquid phase sintered aluminum alloy member are determined by the same method as the method for measuring the average particle size and the maximum diameter of the aluminum alloy particles.

The hard particles preferably have a shape with no sharp edge, in other words, have a shape as similar as possible to a spherical shape. For example, the aspect ratio is preferably 1.0 or more and 3.0 or less.

The counterpart aggressiveness can be reduced by using hard particles having a shape similar to a spherical shape or hard particles having non-sharp edges compared with the case of using elongated particles or other particles.

The hard particles remain in a matrix material of the aluminum alloy substantially as they are. Therefore, the amount and the size of the hard particles used as a raw material are controlled so as to obtain a desired content and a desired size of the hard particles in the alloy.

[Compacting Process]

The prepared raw material powder is filled into a die and compacted. For example, cold compaction, such as cold die compaction, can be used. The compaction pressure may be 2 tons/$cm^2$ or more and 10 tons/$cm^2$ or less. By adjusting the shape of a cavity of this die, a green compact having a complex shape can also be obtained.

[Sintering Process]

The green compact thus obtained may be sintered at a liquid phase appearance temperature under publicly known conditions. Typical sintering conditions may include an inert atmosphere, such as a nitrogen or argon atmosphere; a temperature of 540° C. or more and 620° C. or less; and a time of 0 (the temperature starts to decrease at the time when a specified temperature is reached) or more and 60 minutes or less. The sintering temperature may be, for example, 540° C. or more and 560° C. or less for the Al—Si—Mg—Cu-based alloy and may be 580° C. or more and 620° C. or less for the Al—Zn—Mg—Cu-based alloy.

When a composite powder obtained by mixing a high-alloyed aluminum alloy powder and a high-purity aluminum powder is used as a raw material powder, a portion of alloying elements of the high-alloyed aluminum alloy powder is dispersed in the high-purity aluminum powder by the sintering process. For example, for an Al—Si-based alloy, a composite powder obtained by mixing a high-Si aluminum alloy powder containing 6 mass % or more of Si and a high-purity aluminum powder substantially free of Si is used as a raw material powder. This composite powder is processed into an aluminum alloy having a two-phase structure including a high-Si aluminum alloy phase containing 6 mass % or more of Si and a low-Si aluminum alloy phase containing 2 mass % or less of Si.

[Softening Process]

The obtained sintered body is subjected to a heat treatment and a softened material having an improved elongation is provided. FIG. 1 illustrates the elongation and the hardness of a sintered body after a softening process and an aging process. The sintered body is obtained by mixing 1 mass % of a 2-μm alumina powder and an Al—Si—Mg—Cu-based alloy powder (average particle size: 70 μm) having a composition of Al-14Si-2.5Cu-0.5Mg (unit: mass %) and subjecting the mixed powder to compacting and liquid phase sintering. The softening process involves heating the sintered body at 495° C. for 1 hour followed by water quenching (Water Quench, WQ). The aging process involves a heat treatment (aging treatment) at 175° C. for 8 hours. The graph of FIG. 1 illustrates that, after the sintered body is subjected to the heat treatment (corresponding to a solution treatment here), the elongation (elongation at break) increases from about 1.0% to about 3.3% with decreasing hardness (Rockwell hardness). After the aging treatment is subsequently performed, the hardness is improved and the elongation is reduced by precipitation hardening. When a softened material having an improved elongation is subjected to sizing in a straightening process described below, the softened material conforms easily to a die at the time of sizing and as a result occurrence of cracks can be reduced, which allows efficient production of a member having high dimensional accuracy. The elongation (elongation at break) of the softened material is preferably 2% or more, more preferably 3% or more.

Figure 2:
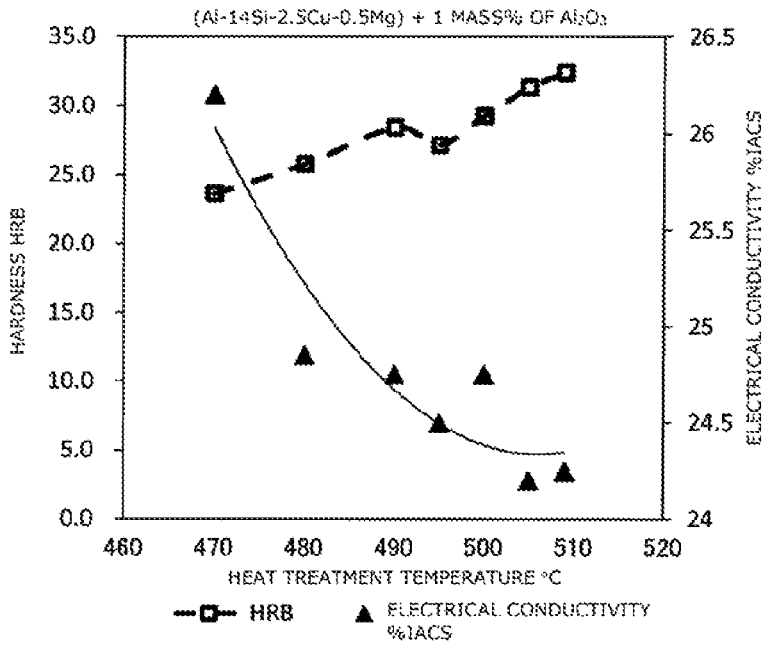
FIG. 2 includes graphs illustrating the heat treatment temperature, the hardness, and the electrical conductivity in a softening process in the method for producing a liquid phase sintered aluminum alloy member according to the embodiment.
Figure 2:
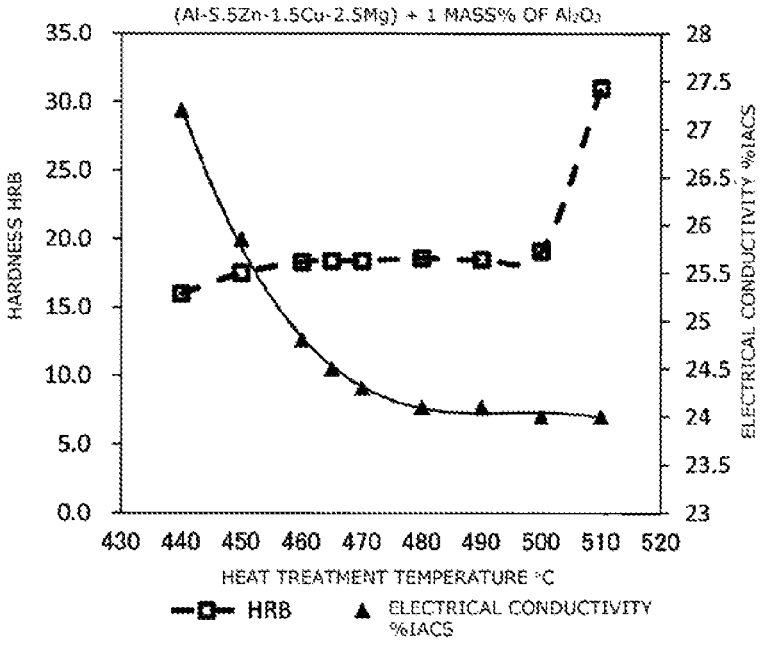

FIG. 2 illustrates the heat treatment temperature applied to a sintered body and the hardness HRB and the electrical conductivity % IACS of the sintered body (softened material) that is cooled to ordinary temperature after the heat treatment. The upper graph of FIG. 2 illustrates the results of a sintered body obtained by mixing 1 mass % of a 2-μm alumina powder and an Al—Si—Cu—Mg-based alloy powder (average particle size: 70 μm) having a composition of Al-14Si-2.5Cu-0.5Mg, which is the same as in FIG. 1, and subjecting the mixed powder to compacting and liquid phase sintering. The lower graph of FIG. 2 illustrates the results of a sintered body obtained by mixing 1 mass % of a 2-μm alumina powder and an Al—Zn—Cu—Mg-based alloy powder (average particle size: 70 μm) having a composition of Al-5.5Zn-1.5Cu-2.5Mg and subjecting the mixed powder to compacting and liquid phase sintering. The graphs of FIG. 2 both show that the hardness (Rockwell hardness) tends to increase as the heat treatment temperature increases, and there is a region with a substantially constant hardness during the increasing of the temperature. In this region with a constant temperature, alloying elements are completely dissolved in an aluminum alloy. As the temperature further increases, the sintered body becomes a liquid phase. When this liquid material is quenched, the hardness increases. Therefore, the heat treatment performed in a temperature region with a substantially constant hardness can improve the elongation. For the Al—Si—Cu—Mg-based alloy, the heat treatment temperature is preferably 480° C. or more and 520° C. or less, more preferably 480° C. or more and 510° C. or less, and still more preferably 486° C. or more and 496° C. or less. For the Al—Zn—Cu—Mg-based alloy, the heat treatment temperature is preferably 460° C. or more and 500° C. or less, more preferably 470° C. or more and 490° C. or less, and still more preferably 465° C. or more and 495° C. or less. A softened material that is softened at these heat treatment temperatures tends to have an elongation of 2% or more. In contrast, the electrical conductivity of the softened material tends to decrease as the heat treatment temperature increases. The electrical conductivity tends to be high when the heat treatment temperature is excessively low. This is because larger amounts of Cu, Zn, and other elements are dissolved at higher heat treatment temperatures. When the electrical conductivity is low, good plastic workability is obtained due to Cu, Zn, and other elements dissolved and the softened material conforms easily to a die at the time of sizing. Therefore, the heat treatment is preferably performed in a temperature region with low electrical conductivity. The holding time required for softening is a time sufficient for the softened material to form a solid solution. The holding time is about 0.5 hours or more and 2 hours or less, and more preferably 1 hour or more and 1.2 hours or less.

When the solution treatment is performed as a heat treatment applied to the sintered body, the heat treatment conditions are the same as the heat treatment conditions (temperature and holding time) described above. After heating, cooling is preferably performed at a cooling rate of 100° C./s or more.

[Straightening Process]

Figure 3:
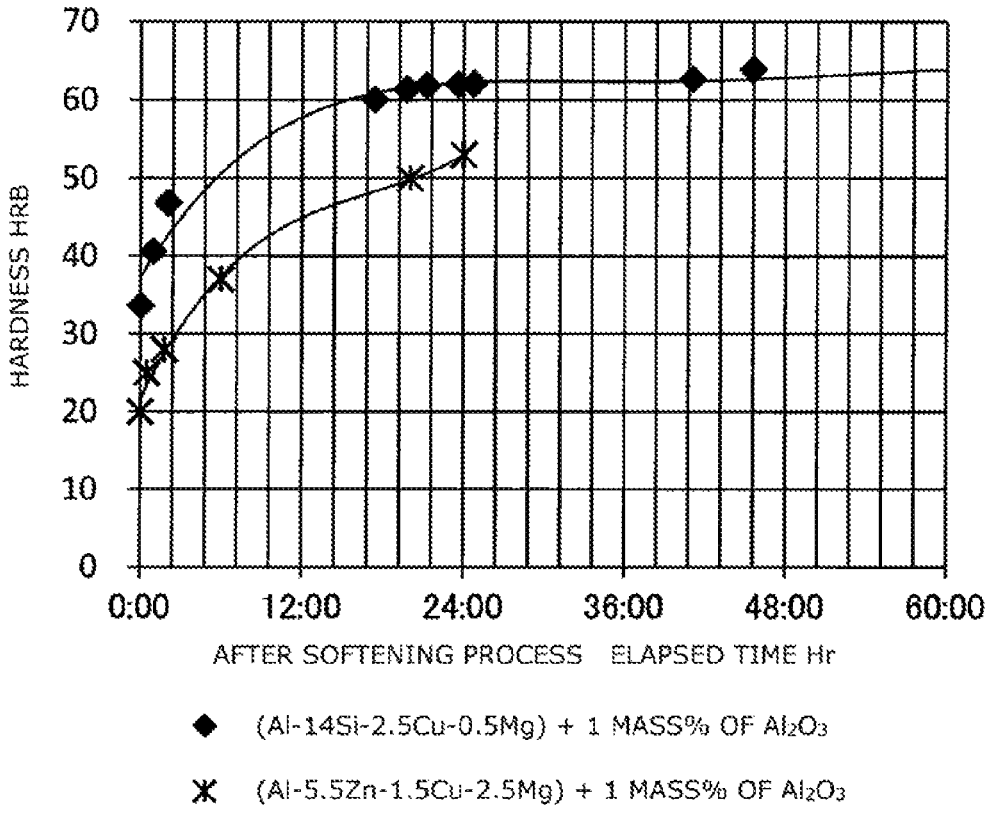
FIG. 3 is a graph illustrating changes in the hardness of alloys after the softening process in the method for producing a liquid phase sintered aluminum alloy member according to the embodiment.

The softened material, especially the softened material having an elongation of 2% or more, is subjected to sizing. FIG. 3 illustrates changes in the hardness of the softened material after the softening process for the sintered body (the same as in FIG. 2). As illustrated in the graph of FIG. 3, the hardness (Rockwell hardness) tends to increase over time. The elongation decreases with increasing hardness. The softened material having a hardness HRB of 50 or less is preferably subjected to sizing. As illustrated in the graph of FIG. 3, for the Al—Si—Cu—Mg-based alloy, the hardness HRB increases to 50 or more at 6 hours after the softening process and the elongation becomes less than 2% accordingly. For the Al—Zn—Cu—Mg-based alloy, the hardness HRB increases to 50 or more at 20 hours after the softening process and the elongation becomes less than 2% accordingly.

In order to size the softened material, the softened material is filled into a compaction space of a die having a desired shape and pressed. A commonly-used die can be employed. Examples of the die include a cylindrical die having a through hole and provided with an upper punch and a lower punch that are to be inserted into the through hole to press the softened material. The softened material is placed in a compaction space defined by the inner circumferential surface of the through hole of the die and the lower punch inserted into one opening of the through hole. The softened material is then pressed at a certain pressure with the lower punch and the upper punch that is inserted into the other opening of the through hole to form a straightened material. The straightened material is ejected from the die. When this die is used, a columnar straightened material shaped in accordance with the contour of the die cavity and the end faces of the upper punch and the lower punch is provided.

Sizing may be hot sizing or cold sizing. Cold sizing can improve dimensional accuracy, whereas hot sizing can improve strength. This sizing may be performed by ironing or upsetting. In particular, the ironing sizing process provides good surface roughness.

[Aging Process]

The straightened material obtained after the sizing is subjected to a heat treatment (aging) and an aged material is obtained in which precipitates are formed. The temperature of the heat treatment may be 170° C. or more and 210° C. or less.

<Liquid Phase Sintered Aluminum Alloy Member>

Since the liquid phase sintered aluminum alloy member produced by the method for producing a liquid phase sintered aluminum alloy member described above is obtained through liquid phase sintering, the amount of voids between raw material powder particles is reduced due to a liquid phase. As a result, the liquid phase sintered aluminum alloy member has high density and high strength. The relative density of the liquid phase sintered aluminum alloy member is 96% or more, and preferably 98% or more. The relative density as used herein refers to a value obtained in accordance with (actual density/true density)×100, where the true density of the member formed of an aluminum alloy is calculated based on the specific gravity of each element. The tensile strength of the liquid phase sintered aluminum alloy member is 200 MPa or more, and more preferably 250 MPa or more.

Since the softened material obtained by subjecting the sintered body formed after liquid phase sintering to the heat treatment is sized, the softened material that can conform to a die at the time of sizing is easily formed. When the liquid phase sintered aluminum alloy member has a right angle, the squareness is 0.1% or less of the entire length. The sizing allows the liquid phase sintered aluminum alloy member to have a surface roughness Rz of 6 or less.

In the liquid phase sintered aluminum alloy member according to the embodiment, the aspect ratio (the ratio of the maximum diameter to the minimum diameter) of matrix material particles constituting a matrix material formed of an aluminum alloy is small (less than 5). That is, by examining the alloy structure, the liquid phase sintered aluminum alloy member is confirmed to be produced by sintering.

Test Example

Liquid phase sintered aluminum alloy members containing various aluminum alloys were prepared. The obtained liquid phase sintered aluminum alloy members were examined for the relative density, the tensile strength, the squareness, and the surface roughness. The liquid phase sintered aluminum alloy members were also examined for the yield.

(Preparation of Samples)

Sample No. 1: Al—Si—Mg—Cu-Based Alloy

An Al—Si—Mg—Cu-based alloy powder (high-alloyed aluminum alloy powder) having a composition of Al-18Si-3.25Cu-0.81Mg (unit: mass %, the same applies hereinafter), a high-purity aluminum powder having a composition of Al-0.5Mg, and an alumina powder were provided as raw material powders. The average particle size of the Al—Si—Mg—Cu-based alloy powder and the high-purity aluminum powder was 50 μm and the average particle size of the alumina powder was 2 μm (maximum diameter: 6 μm). The Al—Si—Mg—Cu-based alloy powder, the high-purity aluminum powder, and the alumina powder provided above were mixed to give a mixed powder. The mass ratio of the Al—Si—Mg—Cu-based alloy powder to the high-purity aluminum powder was 80:20. This ratio corresponds to the mass ratio of a high-Si aluminum alloy phase to a low-Si aluminum alloy phase in a liquid phase sintered aluminum alloy member. The powders described above were mixed so that the alumina powder accounted for 1.0 mass % of the mixed powder. The mixed powder thus obtained was compacted in a die at a surface pressure of 5 tons/cm$^2$, and a cylindrical green compact (35 mm in diameter×10 mm in height) was formed. Subsequently, this green compact was subjected to liquid phase sintering under the sintering conditions of 550±5° C. for 50 minutes in a nitrogen atmosphere.

The obtained sintered body was subjected to a solution treatment involving heating at 495° C. for 1 hour and then water quenching (at 150° C./s). After 0.5 hours, the resulting material was subjected to cold sizing under the condition of 6 tons/cm$^2$. The hardness (Rockwell hardness) HRB of the softened material at 0.5 hours after the solution treatment was 23, and the elongation (elongation at break) was 2% or more. In the sizing, the cylindrical die and the punches described above were used. Subsequently, aging was performed at 175° C. for 8 hours, and a liquid phase sintered Al—Si—Cu—Mg-based alloy sample (liquid phase sintered aluminum alloy member) was prepared accordingly.

Sample No. 2: Al—Zn—Mg—Cu-Based Alloy

An Al—Zn—Mg—Cu-based alloy powder having a composition of Al-6.5Zn-1.75Cu-2.7Mg (unit: mass %, the same applies hereinafter) and an alumina powder were provided as raw material powders. The average particle size of the Al—Zn—Mg—Cu-based alloy powder was 70 μm and the average particle size of the alumina powder was 2 μm (maximum diameter: 6 μm). The Al—Zn—Mg—Cu-based alloy powder and the alumina powder provided above were mixed to give a mixed powder. These powders were mixed so that the alumina powder accounted for 1.0 mass % of the mixed powder. The mixed powder thus obtained was compacted in a die at a surface pressure of 5 tons/cm$^2$ and a green compact was formed. Subsequently, this green compact was subjected to liquid phase sintering under the sintering conditions of 610±5° C. for 20 minutes in a nitrogen atmosphere.

The obtained sintered body was subjected to a solution treatment involving heating at 495° C. for 1 hour and then water quenching (at 150° C./s). After 1 hour, the resulting material was subjected to cold sizing under the condition of 6 tons/cm$^2$. The hardness (Rockwell hardness) HRB of the softened material at 1.5 hours after the solution treatment was 23, and the elongation (elongation at break) was 2% or more. In the sizing, the cylindrical die and the punches described above were used. Subsequently, aging was performed at 175° C. for 8 hours, and a liquid phase sintered Al—Zn—Cu—Mg-based alloy sample (liquid phase sintered aluminum alloy member) was prepared accordingly.

Sample No. 100: Al—Si—Mg—Cu-Based Alloy

As a comparative product, Sample No. 100 was prepared by using raw material powders of Sample No. 1 in accordance with a method known in the art (liquid phase sintering→sizing→solution treatment→aging). Sample No. 100 was prepared in the same conditions as those for Sample No. 1 except that a solution treatment and aging were performed after sizing in terms of treatment order after liquid phase sintering.

Sample No. 200: Al—Zn—Mg—Cu-Based Alloy

As a comparative product, Sample No. 200 was prepared by using raw material powders of Sample No. 2 in accordance with a method known in the art (liquid phase sintering→sizing→solution treatment→aging). Sample No. 200 was prepared in the same conditions as those for Sample No. 2 except that a solution treatment and aging were performed after sizing in terms of treatment order after liquid phase sintering.

(Relative Density)

The relative density of liquid phase sintered aluminum alloy members of the prepared samples was determined. The relative density was calculated in accordance with (actual density/true density)×100, where the actual density was measured using a commercially available densimeter and the true density of the members formed of aluminum alloys each having the composition of each sample was calculated based on the specific gravity of each element. The results are shown in Table 1.

(Tensile Strength)

The tensile strength of the liquid phase sintered aluminum alloy members of the prepared samples was determined with a general-purpose tensile tester in accordance with tensile testing of metallic materials as specified in JIS Z 2241 (2011).

The results are shown in Table 1.

(Surface Roughness)

The surface roughness Rz (ten point height of roughness profile) of the liquid phase sintered aluminum alloy members of the prepared samples was determined with a commercially available surface roughness measuring device in accordance with JIS B 0601 (2001). The results are shown in Table 1.

(Squareness)

Figure 4:
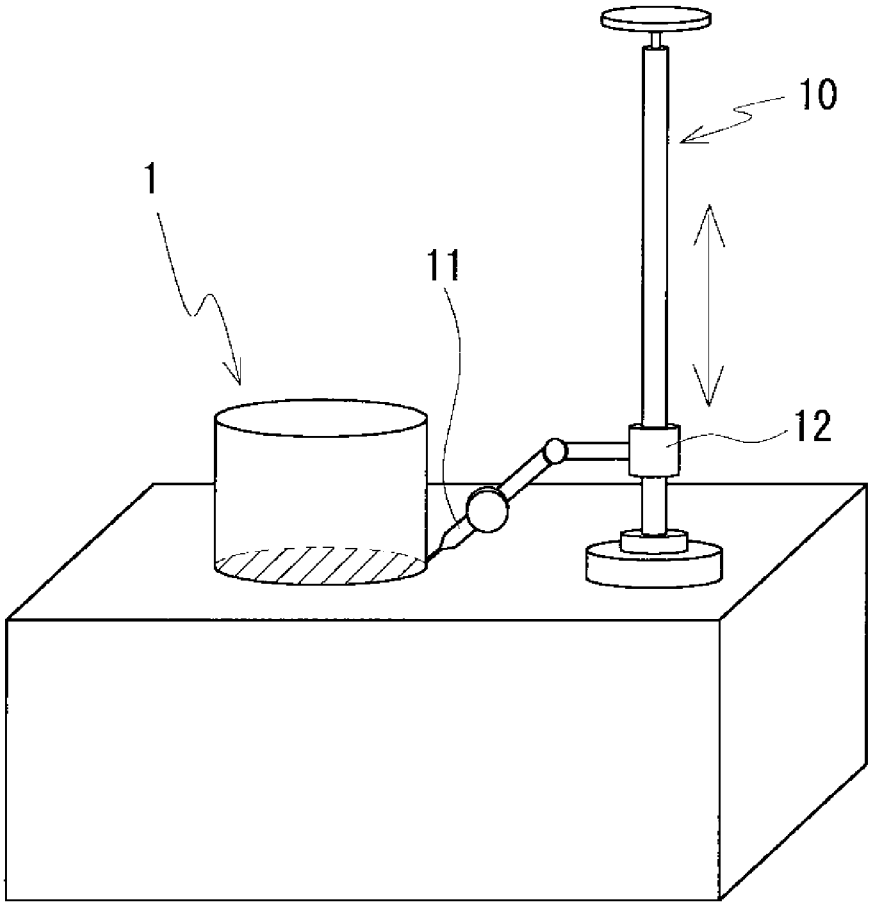
FIG. 4 is an explanatory view for explaining a method for measuring the squareness of a sample in Test Example.

The squareness of the liquid phase sintered aluminum alloy members of the prepared samples was determined with a commercially available square meter (Square Master, available from Mitutoyo Corporation) in accordance with JIS B 0621 (1984). A method for measuring squareness is as follows: for example, as illustrated in FIG. 4, the squareness was determined over the entire side surface in the height direction of a sample 1 by sliding a sleeve 12 along a shaft while a dial gauge 11 of a square meter 10 was in contact with the side surface of the sample 1. The results are shown in Table 1.

(Yield)

The yield of the liquid phase sintered aluminum alloy members of the prepared samples was determined. The yield is the ratio of the number of non-defective members to the total number of members (100 members were prepared) including non-defective members without cracking or chipping and defective members with cracking or chipping. The results are shown in Table 1.

TABLE 1

| Sample No. | Composition Hard Particles | Relative Density (%) | Tensile Strength (MPa) | Surface Roughness Rz | Squareness (%) | Yield (%) |
|---|---|---|---|---|---|---|
| 1 | Al-Si-Mg-Cu-Based Alloy $Al_2O_3$: 1 Mass % | 98 | 317 | 6 or less | 0.04 | 100 |
| 2 | Al-Zn-Mg-Cu-Based Alloy $Al_2O_3$: 1 Mass % | 98 | 491 | 6 or less | 0.05 | 100 |
| 100 | Al-Si-Mg-Cu-Based Alloy $Al_2O_3$: 1 Mass % | 96 | 304 | 10 or more | 2.80 | 20 |
| 200 | Al-Zn-Mg-Cu-Based Alloy $Al_2O_3$: 1 Mass % | 96 | 483 | 10 or more | 3.02 | 30 |

As shown in Table 1, Sample No. 1 and Sample No. 2, which are produced by the production method according to the embodiment, have a high relative density of 98% or more and a high tensile strength of 317 MPa or more.

As shown in Table 1, Sample No. 1 and Sample No. 2, which are obtained by subjecting the liquid phase sintered body to the solution treatment followed by sizing, have a surface roughness Rz of 6 or less, which is smaller than those of Sample No. 100 and Sample No. 200 produced according to the method known in the art. Sample No. 1 and Sample No. 2 have a squareness of 0.05% or less, which is smaller than those of Sample No. 100 and Sample No. 200. These results are provided probably because the heat treatment performed before sizing improves the elongation and softness of the softened material so that the softened material conforms to the shape of the die at the time of sizing. When the liquid phase sintered aluminum alloy member is produced by the production method according to the embodiment, the yield is 100% and the productivity thus improves compared with the method known in the art.

INDUSTRIAL APPLICABILITY

The method for producing a liquid phase sintered aluminum alloy member of the present invention can be suitably used for the production of members that need to have a complex three-dimensional shape and high dimensional accuracy. The liquid phase sintered aluminum alloy member of the present invention can be suitably used as a product material in various fields in which high strength and light weight are desired.

REFERENCE SIGNS LIST

1 Sample
10 Square Meter
11 Dial Gauge
12 Sleeve

The invention claimed is:

1. A method for producing a liquid phase sintered aluminum alloy member, comprising:

a compacting process of compacting a raw material powder containing an aluminum alloy powder containing at least one element selected from Si, Mg, Cu, and Zn, with the balance being Al and unavoidable impurities to form a green compact;

a sintering process of subjecting the green compact to liquid phase sintering to give a sintered body;

a softening and straightening process consisting of a heat treatment after the sintering process, a water quenching after the heat treatment and sizing after the water quenching, wherein the heat treatment having a temperature of more than 480° C. or more and 510° C. or less and a holding time of 1 hour or more and 1.2 hours or less, and the water quenching is performed at a cooling rate of 100° C./s or more;

and an aging process of subjecting the straightened material to a heat treatment to give an aged material in which precipitates are formed.

2. The method for producing a liquid phase sintered aluminum alloy member according to claim 1, wherein the softening process is performed at a temperature sufficient for the softened material to have an elongation of 2% or more.

3. The method for producing a liquid phase sintered aluminum alloy member according to claim 1, wherein the straightening process is performed on the softened material having a hardness HRB of 50 or less.

4. The method for producing a liquid phase sintered aluminum alloy member according to claim 1, wherein the aluminum alloy powder is an Al—Si—Mg—Cu-based alloy powder.

* * * * *